United States Patent [19]

Atchison et al.

[11] 4,256,511

[45] Mar. 17, 1981

[54] HIGH ENERGY WASH OF LJUNGSTROM AIR PREHEATER

[75] Inventors: Hugh C. Atchison; Bobby G. Simmons, both of Tulsa, Okla.

[73] Assignee: The Dow Chemical Company, Midland, Mich.

[21] Appl. No.: 75,914

[22] Filed: Sep. 17, 1979

[51] Int. Cl.[3] ..... B08B 3/02; B08B 9/00

[52] U.S. Cl. ..... 134/46; 134/171; 134/172; 134/181; 239/186

[58] Field of Search ..... 134/46, 56 R, 147, 167 R, 134/168 R, 171–172, 180–181, 183, 198; 239/186

[56] References Cited

U.S. PATENT DOCUMENTS

| | | | |
|---|---|---|---|
| 998,579 | 7/1911 | Herz | 134/172 UX |
| 2,100,343 | 11/1937 | Maycen | 239/186 |
| 2,615,529 | 10/1952 | Lincoln | 134/172 X |
| 4,019,458 | 4/1977 | Kolterer | 134/172 X |
| 4,025,362 | 5/1977 | Frauenfeld | 134/172 X |

FOREIGN PATENT DOCUMENTS

| | | | |
|---|---|---|---|
| 560909 | 10/1957 | Belgium | 134/172 |
| 1105809 | 3/1968 | United Kingdom | 134/46 |

*Primary Examiner*—Robert L. Bleutge
*Attorney, Agent, or Firm*—V. Dean Clausen

[57] ABSTRACT

The apparatus disclosed herein is designed for removing solid deposits, which interfere with heat transfer, from the surface of the basket section in an air preheater. In one type of regenerative air preheater, the basket sections rotate around a hub inside a chamber. An I-beam and threaded rod are installed in the chamber parallel to the basket section, at a distance sufficient to allow clearance of the carriage assembly and jet nozzle, or nozzles. The carriage assembly is attached to the rod by a threaded drive block and the carriage straddles the I-beam. A motor drive, which is controlled by an electronic programmer, rotates the threaded rod, to drive the carriage incrementally along the rod and beam. The carriage also includs roller type bearings which aid movement of the carriage along the beam. As the basket section rotates parallel to the moving carriage, a high pressure water jet, or jets, is directed through the nozzle to wash the solid deposits off of the basket section. The high energy jet stream achieves complete removal from the basket section of all deposits which can impede gas flow and limit heat transfer.

18 Claims, 3 Drawing Figures

HIGH ENERGY WASH OF LJUNGSTROM AIR PREHEATER

BACKGROUND OF THE INVENTION

The invention relates to a cleaning apparatus. More specifically, the invention is directed to an apparatus for cleaning the basket section of an air preheater, using a high energy wash stream.

Utility companies install air preheaters on steam generators to recover the sensible heat from the flue gas. In a conventional regenerative preheater, such as a Ljungstrom, the rotating baskets provide a continuous two-step process for preheating the combustion air. As the baskets rotate through the flue gas duct, hot flue gas flows through the corrugated baskets and heats the metal. As the baskets rotate into the air duct, cold combustion air is heated by contact with the hot metal. Air preheater seals separate the flue gas from the combustion air. During the heat transfer step, if the flue gas is cooled below its dew point, a condensate, which contains corrosive acidic materials, can form on the metal basket surfaces. Within a short time the deposits can cause a heat transfer problem in the preheater.

The heat transfer problem is particularly troublesome when coal is used as fuel for the boiler. The hot flue gas from burning coal carries slag, fly-ash, and other solid materials into the corrugated metal baskets. The larger particles become wedged between the plates in the baskets and cause a partial restriction of the air and gas flow through the preheater. In turn, the partial restriction accelerates deposition of the fly ash on the wet metal surfaces and rapidly causes a substantial pressure drop across the preheater. For example, at times the fly ash deposits can severly restrict passage of combustion air through the preheater, so that the boiler cannot operate at full load.

Prior methods for cleaning the preheater baskets have included steam blow, air blow, fire hose wash, system spray wash, and several other washing techniques. None of these procedures have been entirely satisfactory, particularly in trying to clean preheaters installed on boilers which burn coal with a high ash content. Prior to the invention of the present apparatus, the only alternative has been to periodically replace the preheater baskets, at considerable expense and downtime.

SUMMARY OF THE INVENTION

The apparatus of this invention is specifically designed for cleaning the basket section of an air preheater. In one type of an air preheater, the basket section is enclosed within a chamber and the baskets rotate around a hub in the chamber. An elongate beam is spaced from and parallel to the basket section. The beam is secured at its inner end to the hub and at its outer end to the inside wall surface of the chamber. Spaced from and parallel to the beam is a threaded rod. The inner end of the rod is mounted on a rotatable bearing member secured to the hub. The outer end of the rod extends through the chamber wall and near its outer end the rod is carried in a similar rotatable bearing member secured to the inside wall surface of the chamber.

A drive unit is mounted on the outside wall surface of the chamber. The drive unit engages the outer end of the threaded rod to enable the unit to rotate the rod. The cleaning apparatus also includes a carriage assembly, which straddles the threaded rod and beam. This assembly includes at least one drive block, which is secured to the carriage assembly, and which has a threaded opening therein for engaging the threaded rod. The drive block thus enables the carriage to move along the rod as it rotates. The carriage assembly also includes top and bottom roller means, which engage the top and bottom faces of the beam, to facilitate moving the carriage assembly along the beam.

Another component of this cleaning apparatus is a nozzle assembly. The nozzle assembly includes a head block, which is secured to the carriage assembly, such that the nozzle lies between the beam and the basket section. The nozzle asembly also includes a jet nozzle, which is installed on the head block such that it communicates with a fluid passage inside the block. Another part of the nozzle assembly is an inlet line which connects the fluid passage into a source which contains a washing fluid. Another component of the cleaning apparatus is an automatic programmer unit. The programmer unit includes a means for actuating the drive unit and a first and second means. The washing fluid is directed through the inlet line and the jet nozzle and into the basket section, to thereby remove solid deposits from the basket section as it rotates around the hub.

The first counter means is associated with the basket section. As the basket section rotates, the first counter is adapted to register each complete revolution of the basket and it also actuates the second counter. The second counter means is associated with the drive unit actuating means and the threaded rod. The second counter actuates the drive unit actuating means to rotate the threaded rod a set number of revolutions. This enables the second counter to advance the carriage assembly a predetermined distance along the threaded rod.

DESCRIPTION OF THE DRAWINGS

In FIG. 1 the cleaning apparatus is installed in its operating position within the preheater.

DESCRIPTION OF A PREFERRED EMBODIMENT

Figure 1:
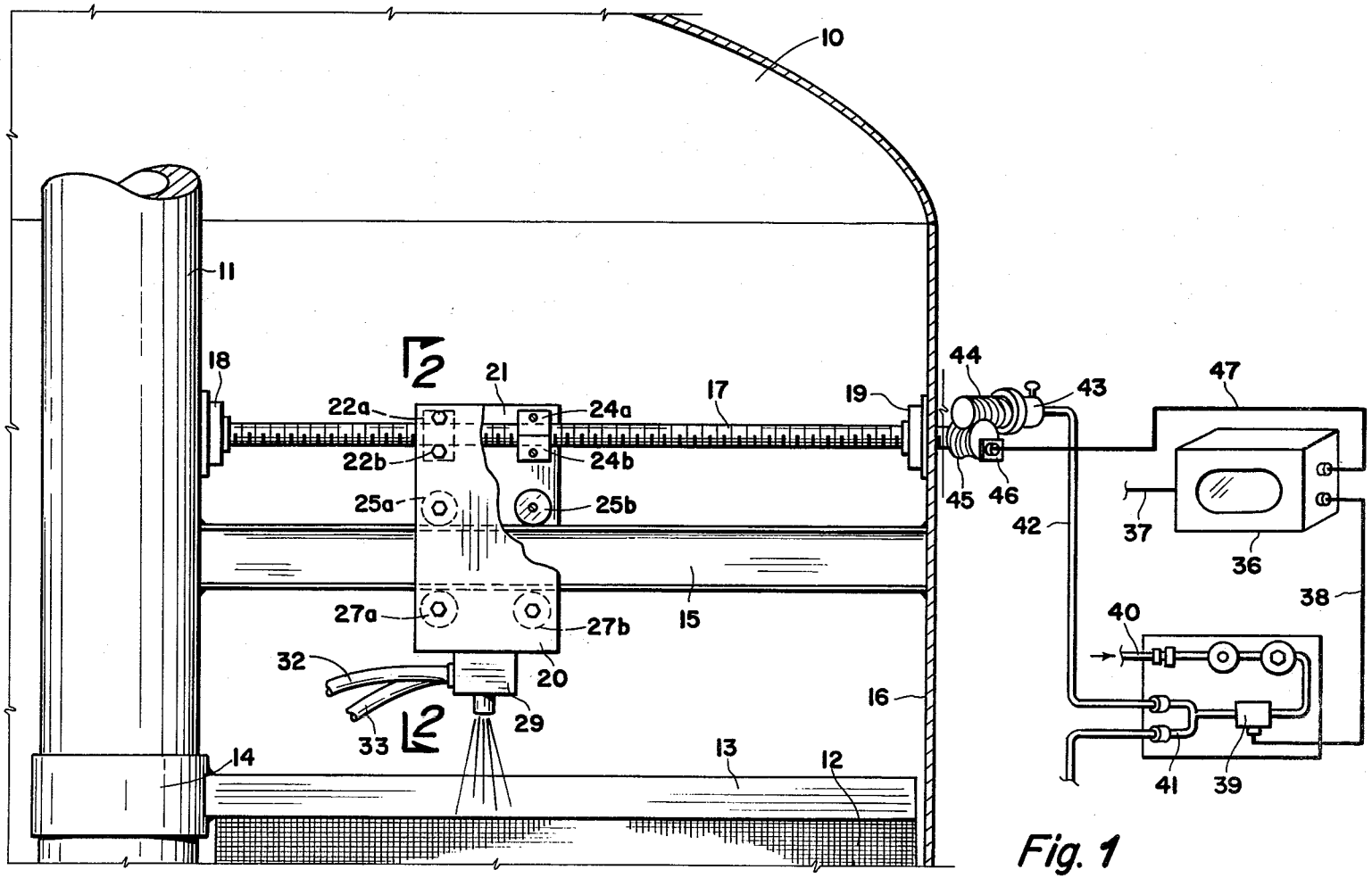
FIG. 1 is an elevation view, partly in section and partly schematic, which illustrates the basket section of an air preheater and the cleaning apparatus of this invention.

Referring to the drawing, and particularly to FIG. 1, the air preheater is generally defined by chamber 10, a hub 11, and a basket section 12. The basket section 12 is made up of adjacent layers of corrugated metal heating elements. These elements, which act as heat transfer surfaces, are generally referred to as baskets. Within chamber 10 the baskets are divided into pie-shaped sections. The top of each basket section is defined by an upright rib 13. To simplify the illustration only one of the basket sections 12 and one of the ribs 13 are shown in the drawing.

Each of the ribs 13 is mounted at one end on a rotor 14. The opposite end of each rib is free to allow the basket sections to rotate around the stationary hub 11. The rotor is usually driven by an air motor or an electric motor. If an air motor is used, the rotational speed is usually controlled by a tachometer and an air throttle valve. If an electric motor is used, the rotational speed can be controlled by a variable speed drive. The drive motor and speed control components for the rotor are not shown in the drawing.

An I-beam 15 is mounted in chamber 10 above and parallel to the top of the basket sections 12. Beam 15 is fastened at its inner end to hub 11, and at the outer end to the inside wall surface 16 of chamber 10. As shown in FIG. 1, the beam can be permanently welded to the hub 11. Alternatively, the beam can be bolted into bracket members attached to the hub, if it is desired to remove the beam between cleaning operations. The alternate embodiment for fastening the beam to the hub in the chamber is not illustrated in the drawing.

A threaded rod 17 is positioned in chamber 10 above and parallel to the beam 15. The inner end of the rod is carried in a rotatable flange bearing 18, which is installed on hub 11. At the other end the rod 17 is carried in a similar rotatable flange bearing 19, which is installed on the inside wall surface 16 of chamber 10. As shown in FIG. 1, the outer end of rod 17 extends beyond the wall of chamber 10, to engage a reduction gear, which is described in more detail later.

Figure 2:
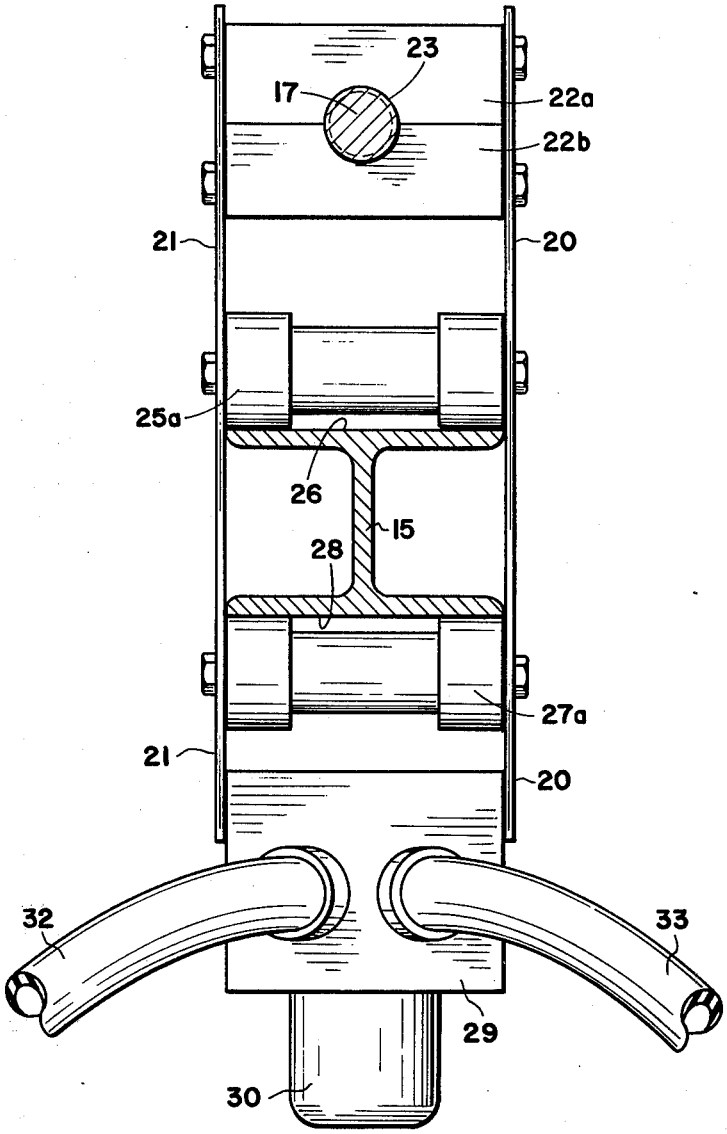
FIG. 2 is a detail view of the carriage assembly which forms a part of the cleaning apparatus shown in FIG. 1. This view of the carriage assembly is taken along line 2—2 of FIG. 1.

Referring particularly to FIGS. 1 and 2, the cleaning apparatus includes a carriage assembly positioned inside chamber 10. The basic structure of the carriage assembly is defined by two upright plate members 20 and 21. These plates are spaced apart such that the carriage assembly straddles the threaded rod and the I-beam 15. At the top of the carriage assembly is a drive block, which is split lengthwise, such that the block includes an upper section **22*a* and a lower section 22*b*. When the drive block is in its assembled position on rod 17, as shown in FIG. 2, the upper and lower sections of the block are bolted into the plate members 20 and 21. In addition, the drive block has a central threaded opening 23 therein which engages the threads on rod 17**. The drive block thus enables the carriage assembly to be driven along the threaded rod, as explained in more detail later.

If desired, the carriage assembly can also include a second block for supporting the assembly on the threaded rod. The support block which is illustrated in FIG. 1 is also split lengthwise to provide an upper section **24*a* and a lower section 24*b*, with each of the sections being bolted into the plate members 20 and 21 in the same fashion as the drive block. When the support block is in its assembled position, it also has a central opening therein (not shown). The opening in the support block, however, is not threaded, so that the block fits loosely around the threaded rod 17. The carriage assembly also includes two pairs of roller pins, which guide the carriage assembly along the I-beam 15. One pair of these roller pins, indicated at 25*a* and 25*b*, are bolted into the plate members 20 and 21 and these rollers engage the top face 26 of beam 15. The other pair of roller pins, indicated at 27*a* and 27*b*, are also bolted into the plate members 20 and 21, and these pins engage the bottom face 28 of beam 15**.

Figure 3:
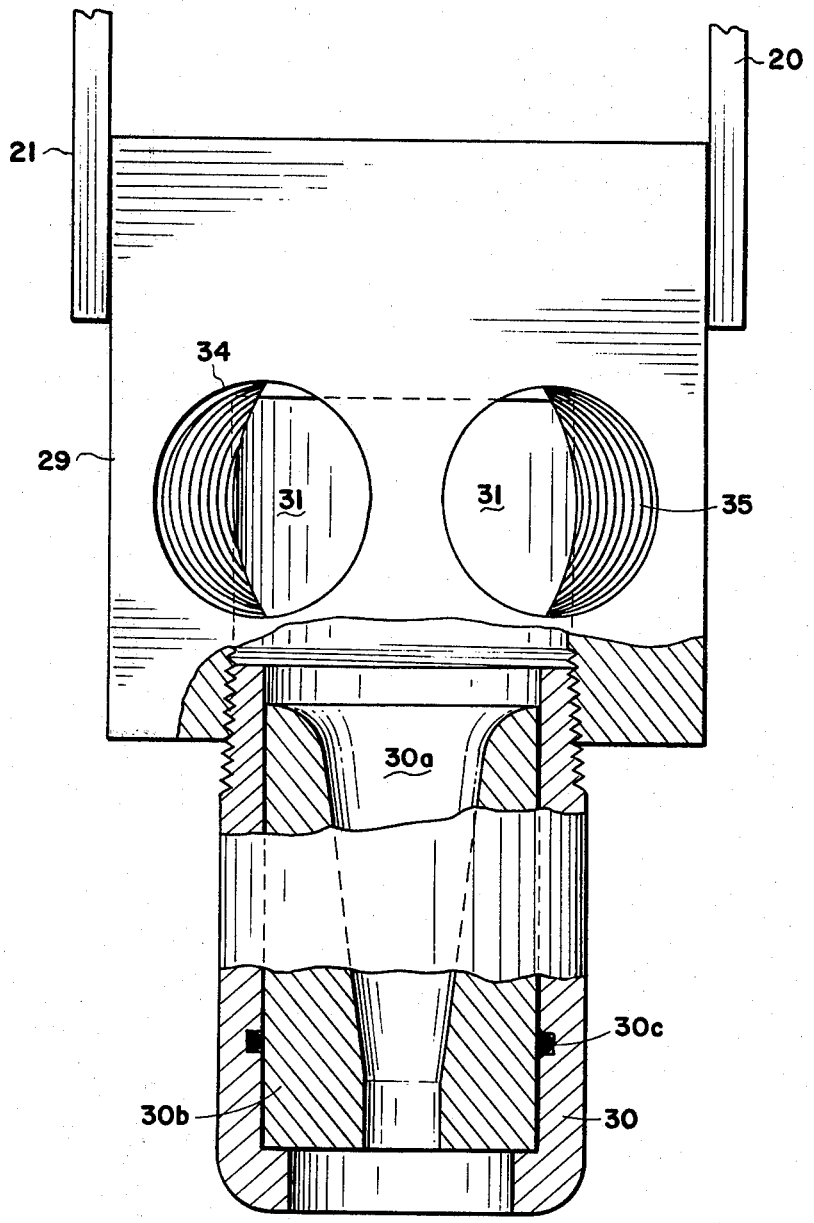
FIG. 3 is a detail view, partly in-section, of a nozzle assembly, which forms a part of the carriage assembly illustrated in FIG. 1.

Another part of the present cleaning apparatus is provided by a nozzle assembly. Specifically, the nozzle assembly is made up of a head block 29 and a jet nozzle 30. As shown in FIG. 2 the head block 29 is fastened into the plate members 20 and 21 just below the bottom rollers **27*a* and 27*b*. The head block is fastened into the plate members by socket screws, or some other fastening means which enables the nozzle to be conveniently removed. As indicated in FIG. 3, the nozzle 30 fits into the head block 29, such that the bore 30*a* in the nozzle is in direct communication with a fluid passage 31 in the center of the block. In the nozzle assembly illustrated herein, the fluid passage 31 is connected into a source of a washing fluid (not shown) by two inlet lines 32 and 33. However, the use of two inlet lines for carrying the washing fluid into the nozzle assembly is not essential to the practice of this invention. In the embodiment shown herein, two inlet lines are used to prevent an undesirable pressure drop through the jet nozzle 30**.

OPERATION

The apparatus of this invention is specifically designed for removing solid deposits from the basket section in a Ljungstrom air preheater. The same apparatus can be adapted to clean the basket section in other conventional air preheaters. The invention will now be illustrated by describing a typical procedure for cleaning the basket section of a Ljungstrom preheater. In this procedure the basket section of the preheater is positioned horizontally, as illustrated in FIG. 1. The same procedure can be used to clean preheaters in which the basket section is positioned vertically.

The first step is to install the carriage assembly and nozzle assembly on the threaded rod 17 and I-beam 15. Because the drive block and the support block are split into upper and lower sections, the carriage assembly can be easily attached to rod 17, at any point, rather than having to run the blocks onto the rod from one end of the rod. When the nozzle assembly is in place, the fluid inlet lines 32 and 33 are connected into the threaded openings 34 and 35 in head block 29 (note FIG. 3). At the other end, the inlet lines are connected into a high pressure pumper (not shown). The preferred washing fluid is an aqueous fluid, for example, water or water containing conventional additives, such as corrosion inhibitors, friction reducers, and the like. Other washing fluids may also be used if desired. The actual choice of the washing fluid depends upon factors such as the type of surface in the preheater which is to be cleaned, and the type of solid deposits which are to be removed from the surface.

At the start of a cleaning operation, the carriage assembly is either positioned on rod 17 next to the hub, or at the opposite end next to the inside wall of chamber 10. In the present description, assume that the carriage assembly is positioned next to the hub before the cleaning operation is commenced. Once the carriage assembly is at its starting position, the basket section 12 is started rotating around hub 11 with an appropriate drive motor (not shown), as explained earlier. The rotational speed of the basket section is set with a tachometer (not shown). The water wash is then pumped through inlet lines 32 and 33 and into the nozzle 30 at a pressure between about 2000 psig and 10,000 psig. Typically, the pressure will be between about 4000 psig and 10,000 psig.

Because the water wash is forced through nozzle 30 at high pressure, it provides a high energy jet stream which can readily penetrate the corrugated heating elements of the basket section 12. The jet stream thus removes the solid deposits from the basket surfaces by high impact forces, vibration and jet stream washing action. Each washing sequence is defined by rotating the basket section 12 through one complete revolution, while the carriage assembly remains in a fixed position on the rod 17 and beam 15.

As each of the ribs 13 in the rotating basket section passes under the fixed beam 15, the rib activates a microswitch (not shown), which is positioned on the beam. The microswitch on beam 15 is, in turn, connected into a first counter means (not shown) in an electronic programmer 36. Programmer 36 is connected by lead 37 into a power supply (not shown). The first counter means is preset for a count of 25. The first counter then counts each of the 24 pie-shaped basket sections in the preheater, to determine that the basket section has made one comple revolution. Then, on the 25th count, the first counter actuates a second counter means (not shown) in programmer 36.

When the second counter is actuated, the programmer 36 sends a signal through lead 38, to an air solenoid valve 39. The signal causes valve 39 to open and allow an air supply in line 40 to flow through one side of an air header 41, and line 42, into an air motor 43. The motor 43 engages a gear box 44. The gear box, in turn, engages a reduction gear 45, which is mounted on the outer end of the threaded rod 17.

When motor 43 is started by the air supply, the motor rotates rod 17 and thus causes the carriage assembly to advance along the rod. In the embodiment of this invention rod 17 has eight threads per inch. This means that the carriage assembly will move ⅛ of an inch along rod 17 each time the rod makes one complete revolution. Understandably, the threads on rod 17 can be changed to permit the carriage assembly to move a greater or shorter distance on the rod.

An eccentric cam (not shown) is mounted on the end of rod 17. Each time the rod makes one complete revolution this cam trips a microswitch 46, which is mounted on the drive unit. In turn, the microswitch 46 sends a signal through lead 47 to the second counter means in programmer 36. The second counter means thus registers each complete revolution of rod 17 and signals programmer 36 to stop motor 43 when a preset count is reached.

In the procedure described herein, the second counter is preset at 6 counts. This allows the carriage assembly to be driven along the threaded rod a total distance of ¾ of an inch before the motor 43 is stopped. When motor 43 stops, the first counter is again actuated to start counting the pie-shaped basket sections in the preheater. At the point where the first counter again reaches the preset count, the second counter is actuated to advance the carriage assembly on the rod 17 for the preset distance of ¾ of an inch. The electronic programmer 36 also includes a third counter means. This counter registers each complete revolutionof rod 17 and thus accumulates a total count. By reading the total count, the operator can determine the exact position of the carriage assembly, relative to the starting point on rod 17, at any time during the washing step.

In the practice of this invention, the basket section 12 is continuously rotated during the washing step. At the same time, the carriage assembly is moved in increments, until it traverses the entire length of rod 17. Because the carriage assembly moves only a short distance for each washing sequence, the water jet stream from nozzle 30 is able to completely cover the entire basket section of the preheater. After the basket section has been completely washed for the first time, a second washing step can be performed to insure complete cleaning. Before the second washing step is started, the nozzle 30 is changed to a nozzle of a larger bore. The carriage assembly is then driven in the reverse direction on rod 17 to wash the basket section 12 a second time. In the second washing step, the water pressure is usually reduced to between about 2,000 psig and 4,000 psig.

Various other structural details and operating conditions relating to the present cleaning apparatus will now be described. Research studies on cleaning with water jet streams indicate that the diameter of the nozzle bore is directly related to the distance which the jet stream can travel (the kinetic energy of the stream). In the practice of this invention, therefore, the choice of nozzle size is based primarily on the actual depth of the basket section in the preheater to be cleaned. The conventional I-beams used to support and guide the carriage assembly range in size (depth) from 4 inches to 8 inches. The carriage assembly is designed such that the roller pins can be adjusted to fit each of the I-beams in the sizes mentioned above.

Referring to FIG. 3, the nozzle assembly is designed such that the threaded inlet openings 34 and 35, in conjunction with the fluid passage 31, define a path within block 29 which enables a stream lined flow approach into the nozzle bore **30*a***. The objective is to avoid excessive turbulence in the wash stream, which can occur when the flow path of a fluid changes direction. The turbulence problem can be particularly troublesome in high pressure wash streams.

The nozzle bore **30*a* is defined within a nozzle insert 30*b*, with the insert fitting inside the nozzle 30. An O-ring 30*c* is carried in a groove on the inner wall surface of the nozzle 30. This O-ring provides a fluid pressure seal between the insert 30*b* and the nozzle 30. Nozzle inserts of several different sizes may be used in nozzle 30**, so that the size or configuration of the nozzle bore can be readily changed to permit flexibility in performing different cleaning jobs.

EXAMPLE

To further illustrate the practice of this invention, a specific example will now be described, in which the present apparatus is used to clean a Ljungstrom air preheater. The basket section in this preheater was in a horizontal position and had a depth of about 10 feet. The jet nozzle used in this operation had an inside diameter of ⅜ inch. This particular nozzle when used in combination with the head block in the nozzle assembly, incorporates flow characteristics which insure that a stream of high pressure fluid, such as water when leaving the nozzle, will retain one-half of its energy at a point 10 feet from the nozzle.

At the start of the operation, the carriage assembly was positioned on the threaded rod and beam above the basket section and next to the hub in the preheater. The automatic programmer unit was set to move the carriage along the rod, in ½ inch increments, toward the chamber wall, for each revolution of the basket section. The speed of the basket section (usually referred to as a rotating matrix) in relation to the jet nozzle was maintained nearly constant by varying the RPM of the preheater drive unit. The fluid used to clean the basket section was water, which was directed through the jet nozzle at a pressure of from about 7500 psig to 8500 psig and at a flow rate of from about 320 gpm to 370 gpm. At these operating conditions the jet water stream leaving the nozzle had a force of about 1600 hydraulic horse power.

When the carriage assembly reached the chamber wall it was stopped, and the direction of travel on the threaded rod was reversed (e.g. back toward the hub), to achieve a "polishing" wash of the basket section. This washing step was performed at a pressure of about 4000 psi, and the automatic programmer unit was set to advance the carriage along the rod in increments of 1⅜ inches, for each revolution of the basket section. The basket section was rotated at full speed during the entire polishing wash step.

Before the Ljungstrom preheater was cleaned, as described above, the pressure drop across the basket section exceeded 5 inches of water above the design valve. Following this cleaning operation the pressure drop across the basket section was again measured and found to be at the design value. In the practice of this invention. we obtained equally good results in the cleaning of other Ljungstrom air preheaters, using jet nozzles in which the nozzle diameters ranged from ¼ inch to ⅜ inch, and the pressure range was from about 4000 psig to about 10,000 psig. The actual pressure range used in each operation was varied to achieve optimum cleaning results.

Air preheaters, including the Ljungstrom preheater, are well known, as generally described in "Standard Handbook for Mechanical Engineers," 7th Ed., McGraw-Hill Book Company, pages 9–35 to 9–36, inclusive, and in available literature from the various manufacturers. As mentioned earlier, the apparatus and method of this invention can also be used to clean the other conventional preheaters in addition to the Ljungstrom preheater.

The invention claimed is:

1. An apparatus for cleaning the basket section of an air preheater, the basket section being enclosed within a chamber and rotatable around a hub positioned in the chamber, the apparatus comprising;

an elongate beam spaced from and parallel to the basket section, the beam having an inner end secured to the hub and an outer end secured to the inside wall surface of the chamber;

an elongate threaded rod spaced from and parallel to the beam, the rod having an inner end mounted in a rotatable bearing member secured to the hub, the rod having an outer end which extends beyond the chamber wall, and the rod being carried near the outer end in a rotatable bearing member secured to the inside wall surface of the chamber;

a drive unit mounted outside of the chamber, and the drive unit engaging the outer end of the threaded rod, such that the rod can be rotated by the drive unit;

a carriage assembly which straddles the threaded rod and the beam, the carriage assembly including at least one carriage drive block, the drive block being secured to the carriage assembly and having a central threaded opening therein which engages the threaded rod, to thereby enable the carriage assembly to move along the threaded rod as the rod rotates;

the carriage assembly further including top roller means mounted on the carriage assembly and engaging the top face of the beam, and bottom roller means mounted on the carriage assembly and engaging the bottom face of the beam, said roller means enabling the carriage assembly to be moved along the beam;

a nozzle assembly which includes a head block fastened onto the carriage assembly between the bottom roller means and the basket section, a fluid passage inside the head block, a jet nozzle installed in the head block and in communication with the fluid passage and at least one inlet line which connects the fluid passage with a source of washing fluid;

an automatic programmer unit which includes a means for actuating the drive unit, a first counter means associated with the basket section, and a second counter means associated with the drive unit actuating means and with the threaded rod; wherein the washing fluid is directed through the inlet line and jet nozzle and onto the basket section, to thereby remove solid deposits from the basket section;

the first counter means is adapted to register one complete revolution of the rotating basket secton and to actuate the second counter means after registering each complete revolution of the basket section; and the second counter means is adapted to actuate the drive unit actuating means, to cause the threaded rod to rotate a set number of revolutions, as registered by the second counter means, and to thereby advance the carriage assembly a predetermined distance along the threaded rod.

2. The apparatus of claim 1 in which the basket section is horizontally positioned.

3. The apparatus of claim 1 in which the basket section is vertically positioned.

4. The apparatus of claim 1 in which the automatic programmer further includes a third counter means associated with the second counter means and the threaded rod, and which is adapted to register each complete revolution of the threaded rod, to enable the programmer unit to determine the exact position of the carriage assembly on the threaded rod.

5. The apparatus of claim 1 in which the carriage assembly further includes a carriage support block, the block being secured to the carriage assembly adjacent to the carriage drive block, the support block having a lengthwise central opening therein which fits around the threaded rod.

6. The apparatus of claim 5 in which the carriage support block is split lengthwise, to define a block which has an upper section and lower section, each section being secured to the carriage assembly.

7. The apparatus of claim 1 in which the carriage drive block is split lengthwise, to define a block having an upper section and a lower section, each section being secured to the carriage assembly.

8. The apparatus of claim 1 in which the drive unit is defined by an air motor and a gear means mounted on the outer end of the threaded rod and engageable with the air motor.

9. The apparatus of claim 8 in which the drive unit actuating means is defined by an air supply header and a solenoid operated valve, the header being connected into the air motor, and the valve being connected into the automatic programmer unit and the header.

10. The apparatus of claim 1 in which the hub is positioned centrally in the chamber.

11. The apparatus of claim 1 in which the beam is an I-beam.

12. The apparatus of claim 1 which further includes at least two inlet lines, each line connecting the fluid passage into a source of a washing fluid.

13. The apparatus of claim 1 in which the washing fluid is an aqueous washing fluid.

14. The apparatus of claim 1 in which the top and bottom roller means are each defined by a pair of roller pins, the pins in each pair being mounted on the carriage assembly in adjacent relation.

15. The apparatus of claim 1 which is adapted for directing a washing fluid through the jet nozzle at high pressure to clean the basket section of the air preheater.

16. The apparatus of claim 15 in which the washing fluid pressure is from about 2000 psig to about 10,000 psig.

17. The apparatus of claim 16 in which the washing fluid pressure is from about 4000 psig to about 10,000 psig.

18. An apparatus for cleaning the basket section of an air preheater, the basket section being enclosed within a chamber and positioned around a hub positioned in the chamber, the apparatus comprising:

an elongate beam spaced from and parallel to the basket section, the inner end of said beam being secured to a rotatable collar around the hub;

an elongate threaded rod spaced from and parallel to the beam, the rod having an inner end mounted in a rotatable bearing member secured to said rotatable collar, and the rod having an outer end which extends beyond the chamber wall;

a drive unit mounted outside of the chamber, which engages the outer end of the threaded rod, such that the rod can be rotated by the drive unit;

a carriage assembly which straddles the threaded rod and the beam, the carriage assembly including at least one carriage drive block, the drive block being secured to the carriage assembly and having a central threaded opening therein which engages the threaded rod, to thereby enable the carriage assembly to move along the threaded rod as the rod rotates;

the carriage assembly further including top roller means mounted on the carriage assembly and engaging the top face of the beam, and bottom roller means mounted on the carriage assembly and engaging the bottom face of the beam, said roller means enabling the carriage assembly to be moved along the beam;

a nozzle assembly which includes a head block fastened onto the carriage assembly between the bottom roller means and the basket section, a fluid passage inside the head block, a jet nozzle installed in the head block and in communication with the fluid passage and at least one inlet line which connects the fluid passage with a source of washing fluid;

an automatic programmer unit which includes a means for actuating the drive unit, a first counter means associated with the rotatable collar, and a second counter means associated with the drive unit actuating means and with the threaded rod; wherein the washing fluid is directed through the inlet line and jet nozzle and onto the basket section, to thereby remove solid deposits from the basket section;

the first counter means is adapted to register one complete revolution of the rotatable collar around the hub, and to actuate the second counter means after registering each complete revolution; and the second counter means is adapted to actuate the drive unit actuating means, to cause the threaded rod to rotate a set number of revolutions, as registered by the second counter means, and thereby advance the carriage assembly a predetermined distance along the threaded end.

* * * * *